US010703452B2

(12) United States Patent
Kray et al.

(10) Patent No.: US 10,703,452 B2
(45) Date of Patent: Jul. 7, 2020

(54) APPARATUS AND SYSTEM FOR PROPELLER BLADE AFT RETENTION

(71) Applicant: General Electric Company, Schenectady, NY (US)

(72) Inventors: Nicholas Joseph Kray, Mason, OH (US); Peggy Lynn Baehmann, Glenville, NY (US); Stefaan Guido Van Nieuwenhove, Bavaria (DE)

(73) Assignee: General Electric Company, Schenectady, NY (US)

( * ) Notice: Subject to any disclaimer, the term of this patent is extended or adjusted under 35 U.S.C. 154(b) by 154 days.

(21) Appl. No.: 15/295,601

(22) Filed: Oct. 17, 2016

(65) Prior Publication Data

US 2018/0105245 A1 Apr. 19, 2018

(51) Int. Cl.

| | |
|---|---|
| ***B63H 1/20*** | (2006.01) |
| ***B63H 1/26*** | (2006.01) |
| ***B63H 1/28*** | (2006.01) |

(52) U.S. Cl.

CPC ..... *B63H 1/20* (2013.01); *B63H 1/26* (2013.01); *B63H 1/28* (2013.01); *B63B 2748/00* (2013.01); *B63H 2001/283* (2013.01)

(58) Field of Classification Search

CPC ... B63H 1/20; B63H 1/26; B63H 1/28; B63H 2001/283; B63H 2748/00

USPC ..... 415/1, 4.3, 4.5; 416/234, 239, 203

See application file for complete search history.

(56) References Cited

U.S. PATENT DOCUMENTS

| | | | | |
|---|---|---|---|---|
| 1,010,929 | A * | 12/1911 | Loetzer | F04D 29/34 29/889.6 |
| 1,050,119 | A | 1/1913 | Flanders | |
| 4,466,776 | A | 8/1984 | Camboulives | |
| 4,797,066 | A | 1/1989 | Stromberg | |
| 4,842,483 | A * | 6/1989 | Geary | B63H 23/34 416/2 |
| 4,930,987 | A | 6/1990 | Stahl | |
| 5,018,941 | A | 5/1991 | Heurtel et al. | |

(Continued)

FOREIGN PATENT DOCUMENTS

| | | |
|---|---|---|
| CN | 200964178 Y | 10/2007 |
| DE | 71360 C | 10/1893 |

(Continued)

OTHER PUBLICATIONS

International Search Report and Written Opinion issued in connection with corresponding PCT Application No. PCT/US2017/54219 dated Nov. 28, 2017.

*Primary Examiner* — Kenneth J Hansen
*Assistant Examiner* — Maranatha Boardman
(74) *Attorney, Agent, or Firm* — General Electric; Kristi Davidson

(57) ABSTRACT

An apparatus and system for a marine propeller assembly are provided. An aft retention member that may be used with the marine propeller assembly includes a base, an opposing nose and a conic body extending therebetween along a centerline normal to the base. The aft retention member also includes at least one protuberance extending radially away from a surface of the conic body. The protuberance extends axially along a surface of the aft retention member from the base arcuately convergent to a predetermined point between the base and a tip of the nose.

13 Claims, 6 Drawing Sheets

(56) References Cited

U.S. PATENT DOCUMENTS

| | | | | |
|---|---|---|---|---|
| 5,129,787 | A * | 7/1992 | Violette | B29D 99/0028 416/217 |
| 5,256,035 | A | 10/1993 | Norris et al. | |
| 5,611,665 | A | 3/1997 | Angel | |
| 6,312,223 | B1 | 11/2001 | Samuelsson | |
| 6,358,014 | B1 * | 3/2002 | Chou | B64C 11/14 29/889.1 |
| 6,537,031 | B1 | 3/2003 | Bacskay | |
| 8,235,666 | B2 | 8/2012 | Rosenkranz et al. | |
| 8,608,446 | B2 | 12/2013 | Pickens et al. | |
| 8,851,852 | B2 | 10/2014 | Blatchford | |
| 8,851,855 | B2 | 10/2014 | James et al. | |
| 9,039,378 | B2 | 5/2015 | Ulgen | |
| 9,051,845 | B2 | 6/2015 | Bommanakatte et al. | |
| 2011/0293435 | A1 | 12/2011 | McMillan | |
| 2014/0079553 | A1 | 3/2014 | Ulgen | |

FOREIGN PATENT DOCUMENTS

| | | | | |
|---|---|---|---|---|
| JP | H01 162897 | U | * | 11/1989 |
| JP | H01-162897 | U | | 11/1989 |
| JP | 2011-51515 | A | | 3/2011 |
| JP | 2012-66699 | A | | 4/2012 |
| JP | 2016-84081 | A | | 5/2016 |
| KR | 10-2016-0052842 | A | | 5/2016 |
| KR | 20160052842 | A | * | 5/2016 |

* cited by examiner

APPARATUS AND SYSTEM FOR PROPELLER BLADE AFT RETENTION

BACKGROUND

The field of the disclosure relates generally to propulsion systems and, more particularly, to retaining separable propeller blades.

At least some known propulsion systems, such as marine propulsion systems, rely on a rotating propeller assembly including a central hub and propeller blades extending from the central hub. During operation, fluid generally flows across surfaces of the propeller assembly and through gaps defined between blades of the propeller assembly. Performance of the propeller assembly is highly dependent on the shape of the propeller assembly surfaces including those of the blades, central hub, and blade retaining members. As a result, propeller assemblies in which the shape of propeller assembly components are limited by construction methods, material limitations, component sizes, and the like, may result in sub-optimal flow characteristics, decreasing the efficiency of the propeller assembly and requiring more powerful drive systems to achieve required propulsion.

BRIEF DESCRIPTION

In one aspect, an aft retention member includes a base, an opposing nose, and a conic body extending therebetween along a centerline normal to the base. The aft retention member also includes at least one protuberance extending radially away from a surface of the conic body. The protuberance extends axially along a surface of the aft retention member from the base arcuately convergent to a predetermined point between the base and a tip of the nose.

In another aspect, a marine propeller assembly includes a hub including a forward face, an aft face, and a hub body extending therebetween. The hub is configured to couple to a rotatable propulsive shaft and to receive a plurality of propeller blades spaced circumferentially around the hub. The marine propeller assembly also includes an aft retention member configured to couple to the aft face. The aft retention member includes a base, an opposing nose, and a conic body extending therebetween along a centerline normal to the base. The aft retention member includes at least one protuberance extending radially away from a surface of the conic body. The protuberance extends axially from the base arcuately convergent to a predetermined point between the base and a tip of the nose.

In yet another aspect, a marine propulsion system includes a rotatable propulsive shaft extending away from a hull of a water craft and a hub including a forward face, an aft face, and a hub body extending therebetween. The hub body formed of at least one of a metal material and a composite material, and coupled to the propulsive shaft. The hub includes a plurality of circumferentially-spaced composite propeller blades. The marine propeller assembly also includes an aft retention member configured to couple to the aft face. The aft retention member includes a base, an opposing nose, and a conic body extending therebetween along a centerline normal to the base, and at least one protuberance extending radially away from a surface of the conic body. The protuberance extends axially from the base arcuately convergent to a predetermined point between the base and a tip of the nose.

DRAWINGS

These and other features, aspects, and advantages of the present disclosure will become better understood when the following detailed description is read with reference to the accompanying drawings in which like characters represent like parts throughout the drawings, wherein.

Figure 1:
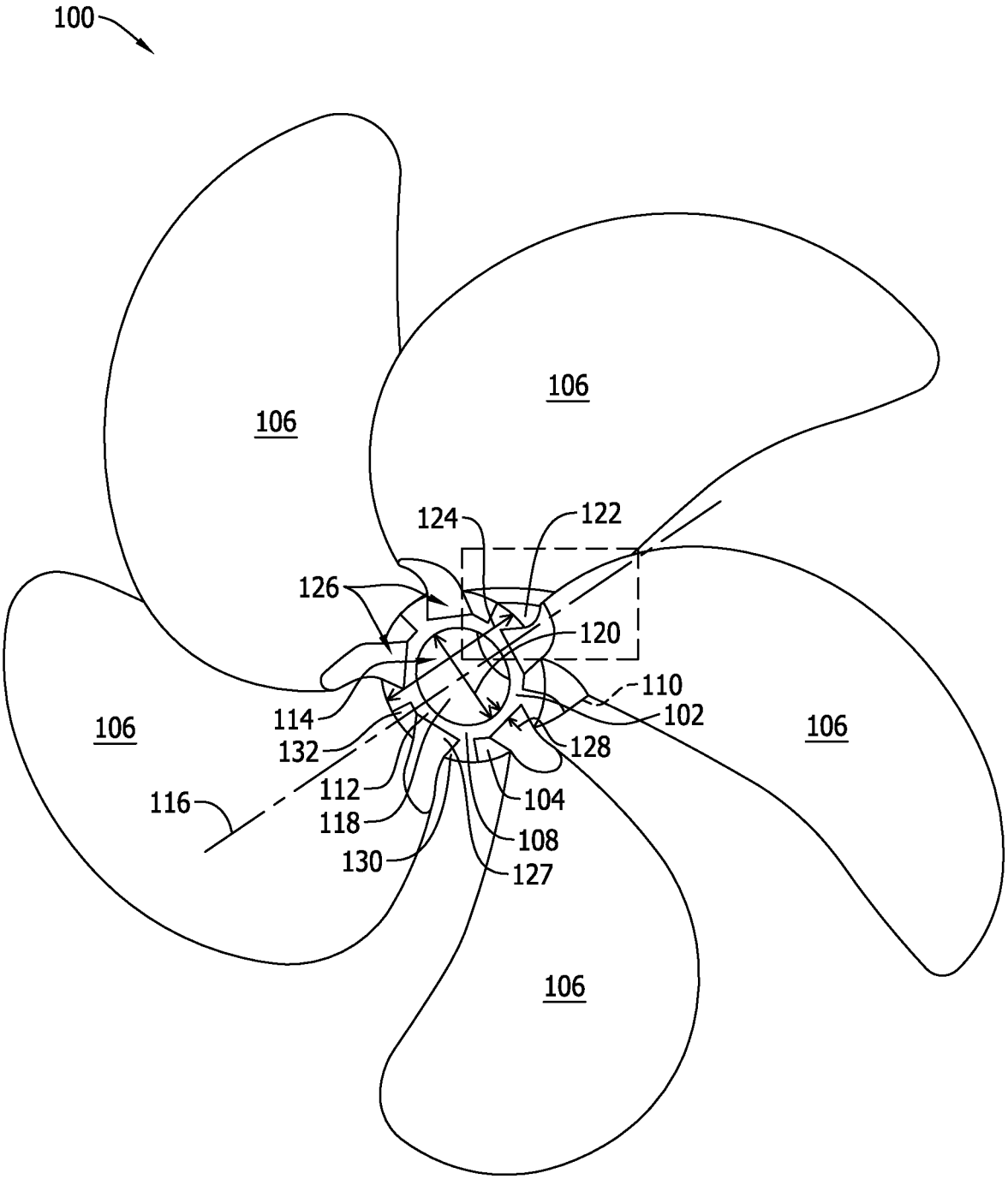
FIG. 1 is a perspective view of a marine propeller assembly in accordance with an example embodiment of the present disclosure.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a," "an," and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

As used herein, the terms "axial" and "axially" refer to directions and orientations that extend substantially parallel to a centerline of the propulsion shaft or propeller hub. Moreover, the terms "radial" and "radially" refer to directions and orientations that extend substantially perpendicular to the centerline of the propulsion shaft or propeller hub. In addition, as used herein, the terms "circumferential" and "circumferentially" refer to directions and orientations that extend arcuately about the centerline of the propulsion shaft or propeller hub.

Embodiments of the marine propeller assemblies and systems described herein provide a cost-effective method for reducing the weight of marine propellers as compared to those that are currently available. The marine propeller assemblies and systems also provide hydrodynamic efficiencies not found in current propeller assemblies. As opposed to monolithic cast and machined propeller assemblies, some embodiments of the marine propeller assemblies described herein are formed of a composite material laid over an internal structural frame and a filler material, such as, but not limited to a structural foam filler. The blades are formed individually and coupled to a metallic hub coupled to a propulsive shaft of a marine vessel. The separable blades provide a manageable weight and size for maintenance of the propeller system. The separable blades are retained in a dovetail groove configured to receive a dovetail of each blade. The blades are retained axially by an axial retention member couplable to the hub and configured to abut an end face of a dovetail associated with each blade. The axial tension or force used to secure each dovetail axially may be adjustable based on an axial bias member formed either in the end face of the dovetail or in the surface of the axial retention member adjacent the dovetail end face. The blades are retained radially and circumferentially using wedges configured to engage a dovetail sidewall and be coupled to the hub using fasteners.

In one embodiment, an aft retention member is coupled to an aft end of the hub system and is formed in a three-dimensional (3-D) conic shape. The aft retention member also provides axial retention for the separable blades. The aft retention member includes contours or protuberances that transition the airfoil shape of the blade into the hub or onto that conic shape of the body of the aft retention member. In addition to providing axial retention of the separable blades in the hub, the aft retention member also provides hydrodynamic benefits and improves performance of the propeller assembly. Such performance improvement may relate to (i) an amount of cavitation during operation; (ii) generated thrust; (iii) open water efficiency; (iv) hull efficiency; (v) relative rotatable efficiency; (vi) mechanical efficiency; (vii) a quasi-propulsive coefficient; and (viii) acoustic efficiency.

Because the blades may be retained in a spiral or arcuate groove in the hub and the root of the blade may include a twist in its root, the transitional contour or protuberances also extends these characteristics from the blade in diminishing fashion to the surface of the aft retention member. In various embodiments, the aft retention member is formed of metal and in some embodiments, the aft retention member is formed of composite material with or without an internal structural frame.

FIG. 1 is a perspective view of a marine propeller assembly 100 in accordance with an example embodiment of the present disclosure. In the example embodiment, marine propeller assembly 100 includes a hub 102, a plurality of wedges 104, and a plurality of separable blades 106.

Hub 102 includes a first face 108, a second face 110 (not shown in FIG. 1, facing away from the view in FIG. 1), and a hub body 112 extending between first face 108 and second face 110. In the example embodiment, first face 108 is spaced axially forward of second face 110. Hub body 112 includes a central bore 114 that is axisymmetric with an axis of rotation 116 of marine propeller assembly 100. Bore 114 includes a radially inner bore surface 118 having an internal diameter (ID) 120. Hub 102 includes a radially outer hub surface 122 having an outer diameter (OD) 124. In one embodiment, outer hub surface 122 includes a plurality of dovetail grooves 126 that extend radially inwardly from outer hub surface 122 a predetermined depth 128. Each of the plurality of dovetail grooves 126 extend generally axially along hub body 112 from first face 108 to second face 110. Each of the plurality of dovetail grooves 126 includes a first undercut sidewall 130 and a second sidewall 132 spaced apart circumferentially. Each of the plurality of dovetail grooves 126 is configured to receive a respective wedge 104 of the plurality of wedges 104 and a dovetail 127 of respective blade 106 of the plurality of separable blades 106.

Figure 2:
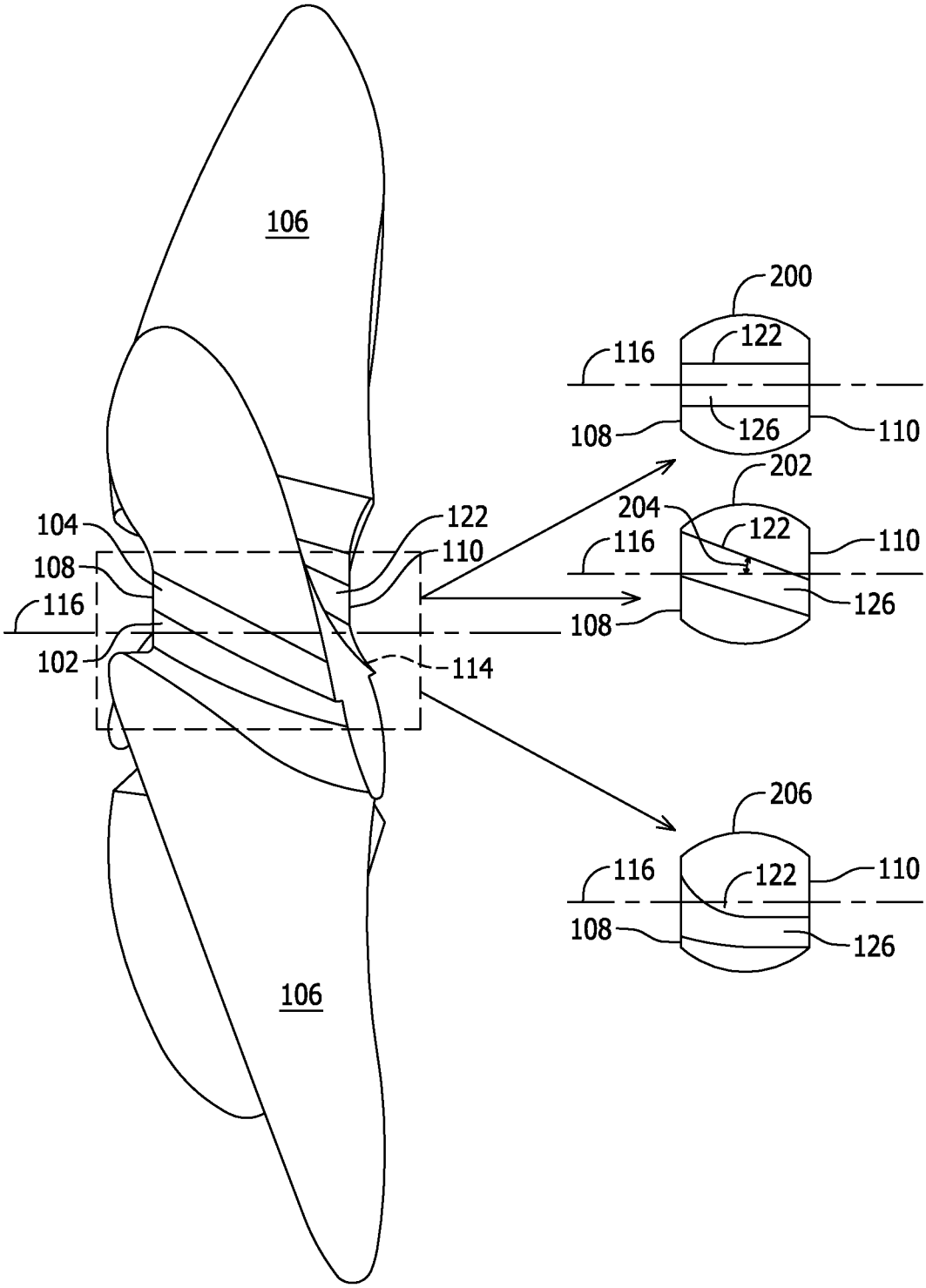
FIG. 2 is a side view of the marine propeller assembly shown in FIG. 1.

FIG. 2 is a side view of marine propeller assembly 100. In the example embodiment, a detail 200 of hub 102 illustrates dovetail groove 126 that extends straight axially between first face 108 and second face 110 parallel to axis of rotation 116. A detail 202 illustrates dovetail groove 126 that extends linearly at a skew angle 204 between first face 108 and second face 110. A detail 206 illustrates dovetail groove 126 that extends arcuately between first face 108 and second face 110.

Figure 3:
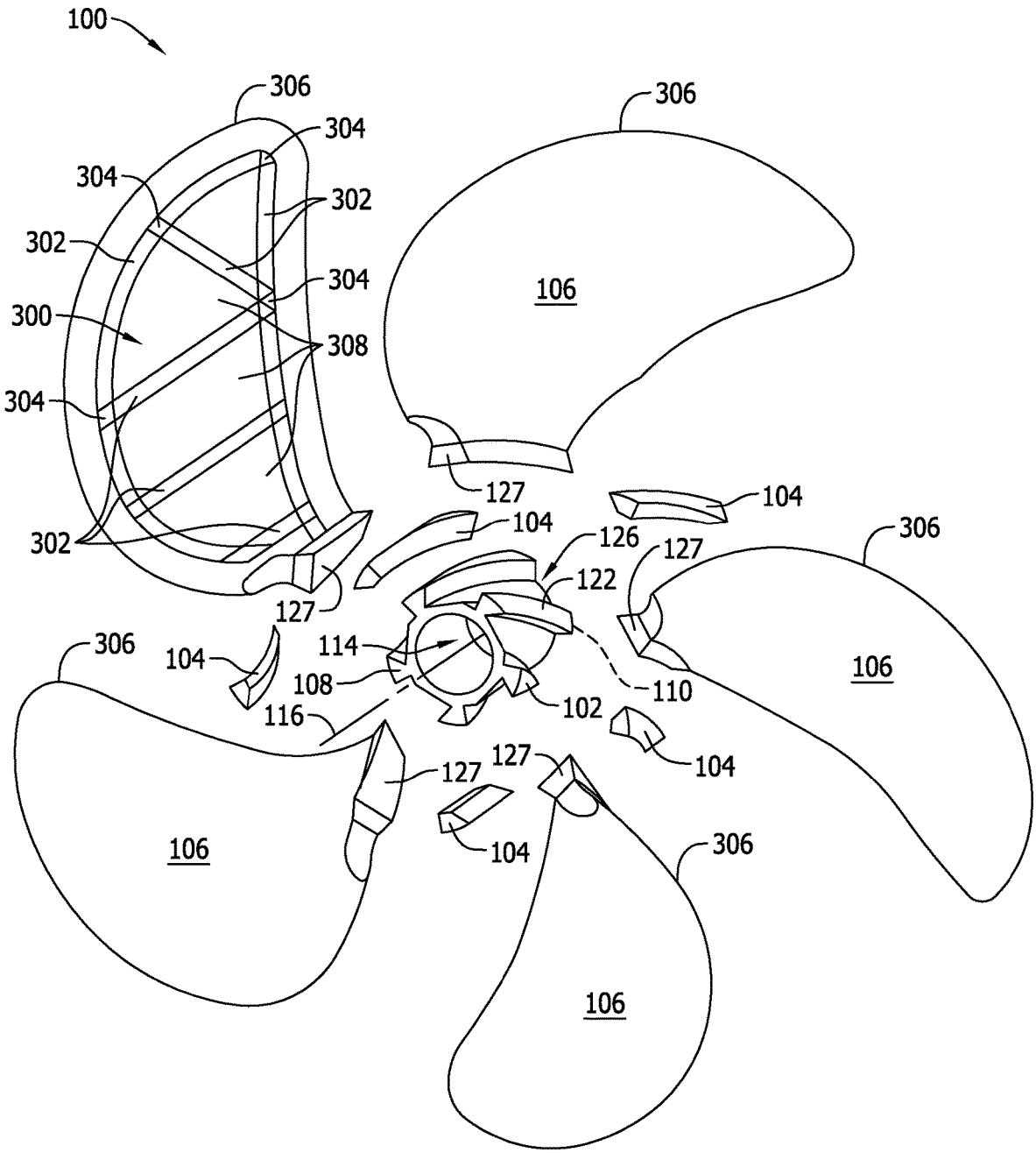
FIG. 3 is an exploded view of the marine propeller assembly shown in FIG. 1 in accordance with an example embodiment of the present disclosure.

FIG. 3 is an exploded view of marine propeller assembly 100 in accordance with an example embodiment of the present disclosure. In the example embodiment, hub 102 is illustrated with plurality of dovetail grooves 126 extending arcuately between first face 108 and second face 110. A blade 106 is illustrated cutaway showing an interior structure 300 that may be used in one embodiment. Interior structure 300 includes a plurality of frame members 302 coupled together at respective frame joints 304. In various embodiments, dovetail 127 is formed of a solid material, such as, but not limited to a metallic material, a composite material, and combinations thereof and coupled to or formed with a respective composite blade portion 306 of a respective blade 106 of plurality of blades 106. In other embodiments, each blade 106 may be formed using interior structure 300 or a foam filler material. The open areas between the interior structure 300, may be at least partially filled by a filler material, such as, but not limited to, a foamed material 308.

Figure 4:
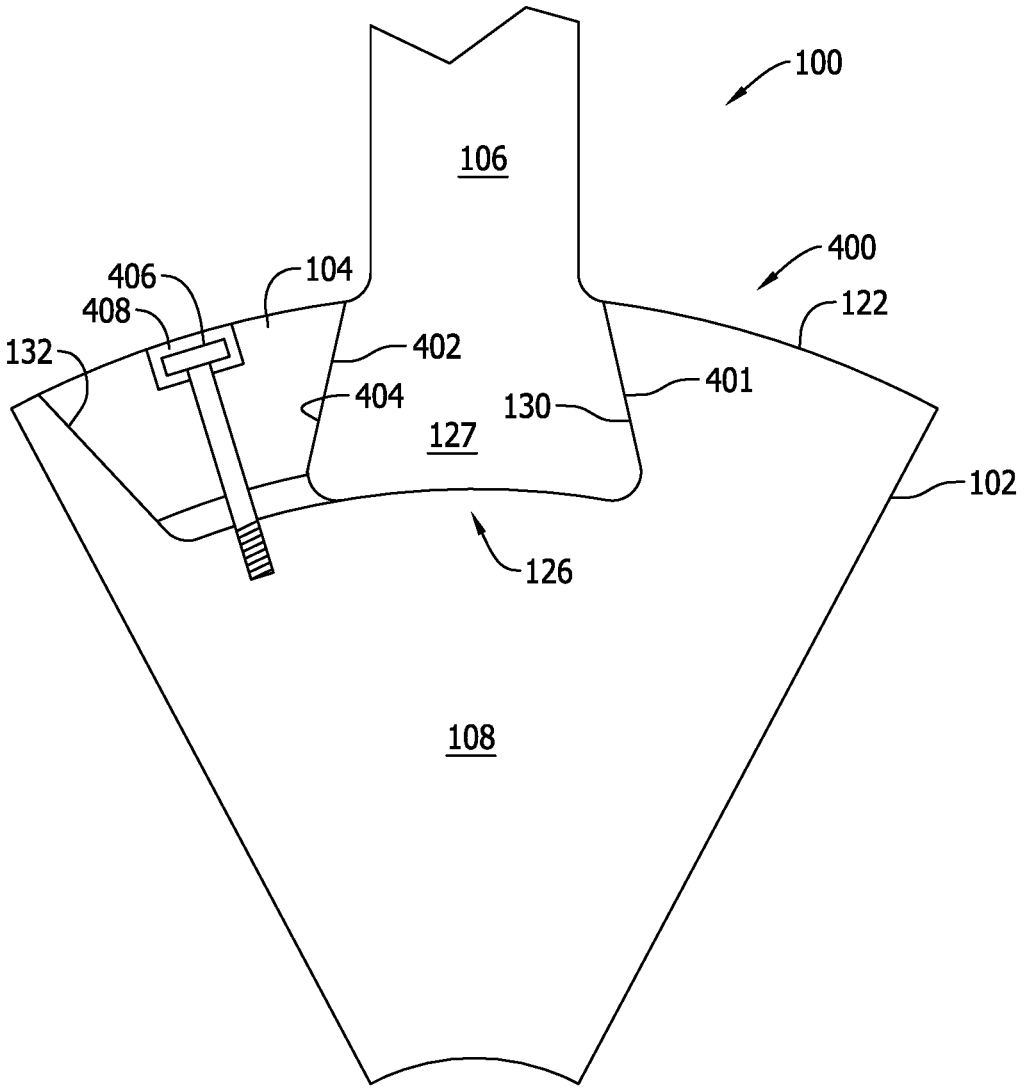
FIG. 4 is an axial view, looking forward of a circumferential segment of the marine propeller assembly shown in FIG. 1.

FIG. 4 is an axial view, looking forward of a circumferential segment 400 of marine propeller assembly 100 (shown in FIG. 1). In the example embodiment, dovetail 127 is retained in dovetail groove 126 by undercut sidewall 130 engaging a complementary first dovetail sidewall 401 and by a first wedge sidewall 402 engaging a complementary second dovetail sidewall 404. Wedge 104 is retained in dovetail groove 126 by one or more fasteners, such as, but not limited to, one or more threaded fasteners 406, for example, one or more bolts. In the example embodiment, a head 408 of fastener 406 is countersunk into a radially outer surface of wedge 104.

Figure 5:
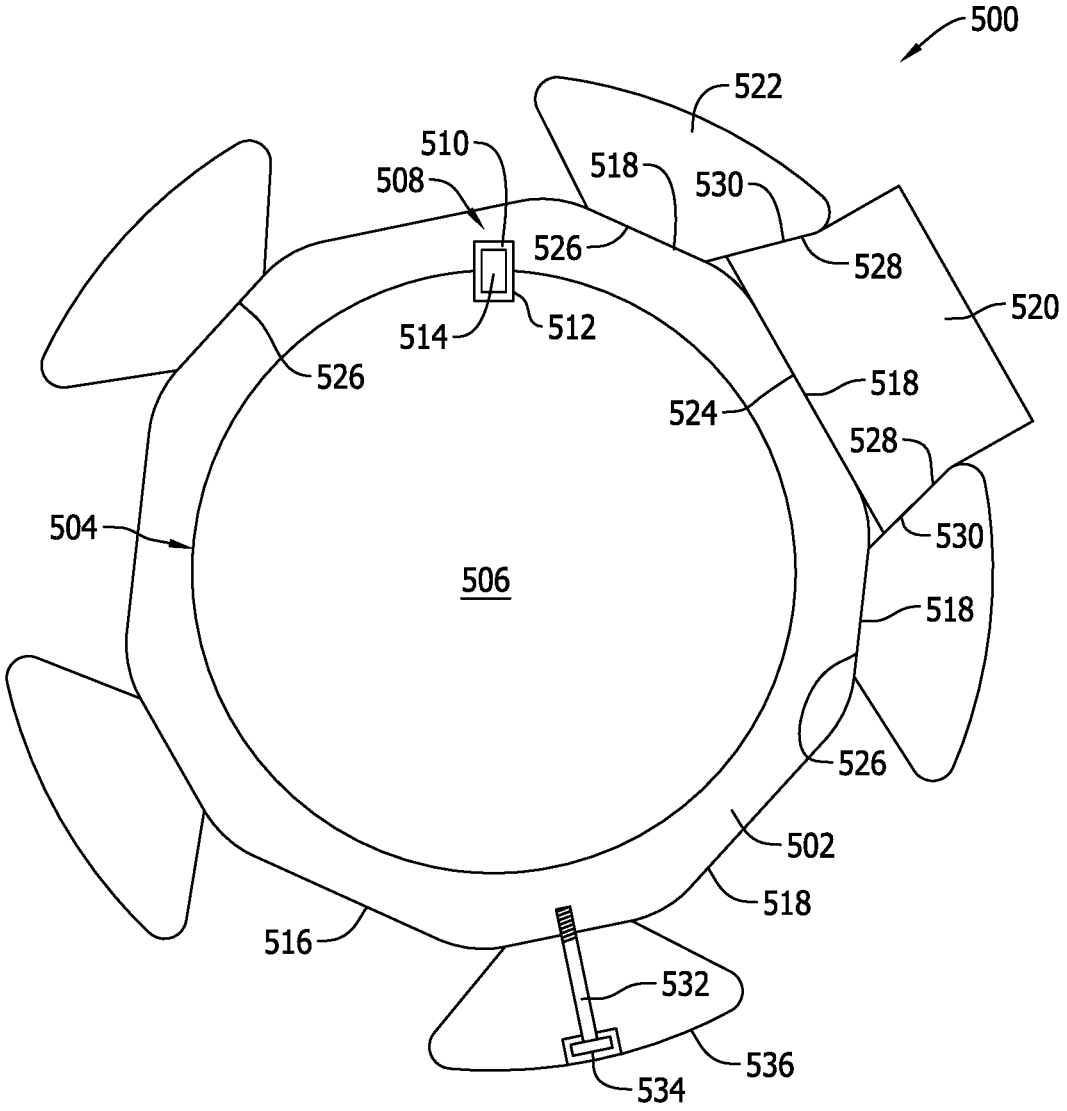
FIG. 5 is an axial view of another embodiment of a marine propeller assembly.

FIG. 5 is an axial view of another embodiment of a marine propeller assembly 500. In the example embodiment, a hub 502 includes a central bore 504 configured to receive a propulsion shaft 506 therethrough. In some embodiments, hub 502 is keyed onto propulsion shaft 506 using, for example, but not limited to, a keyed joint 508 including a keyway 510, a keyseat 512, and a key 514. Keyed joint 508 is used to connect hub 502 to propulsion shaft 506. Keyed joint 508 prevents relative rotation between connect hub 502 to propulsion shaft 506 and facilitates torque transmission between hub 502 and propulsion shaft 506. In one embodiment, an outer radial surface 516 of hub 502 includes a plurality of circumferentially-spaced flats 518. Each flat is configured to receive a blade dovetail 520 or a wedge 522. Specifically, flats 518 are generally planar surfaces that are complementary to a planar radially inner surface 524 of dovetail 520 and a radially inner surface 526 of wedge 522. In various embodiments, flats 518 and surfaces 524 and 526 have contoured surfaces that are complementary with respect to each other. For example, flats may include a generally concave contour while surfaces 524 and 526 include a generally convex contour and vice versa. Other contours may be used and each contour may be a simple contour or may be a complex contour. Blade dovetail 520 is retained against hub by wedges 522 positioned on either circumferential side of blade dovetail 520. Sidewall 528 of wedges 522 are undercut to provide an interference fit with complementary sidewalls 530 of blade dovetail 520. Wedges 522 are retained against hub 502 using for example, fasteners 532, such as, but not limited to threaded fasteners, for example, bolts. In one embodiment, a head 534 of fastener 532 is countersunk into a radially outer surface 536 of wedge 522.

Figure 6:
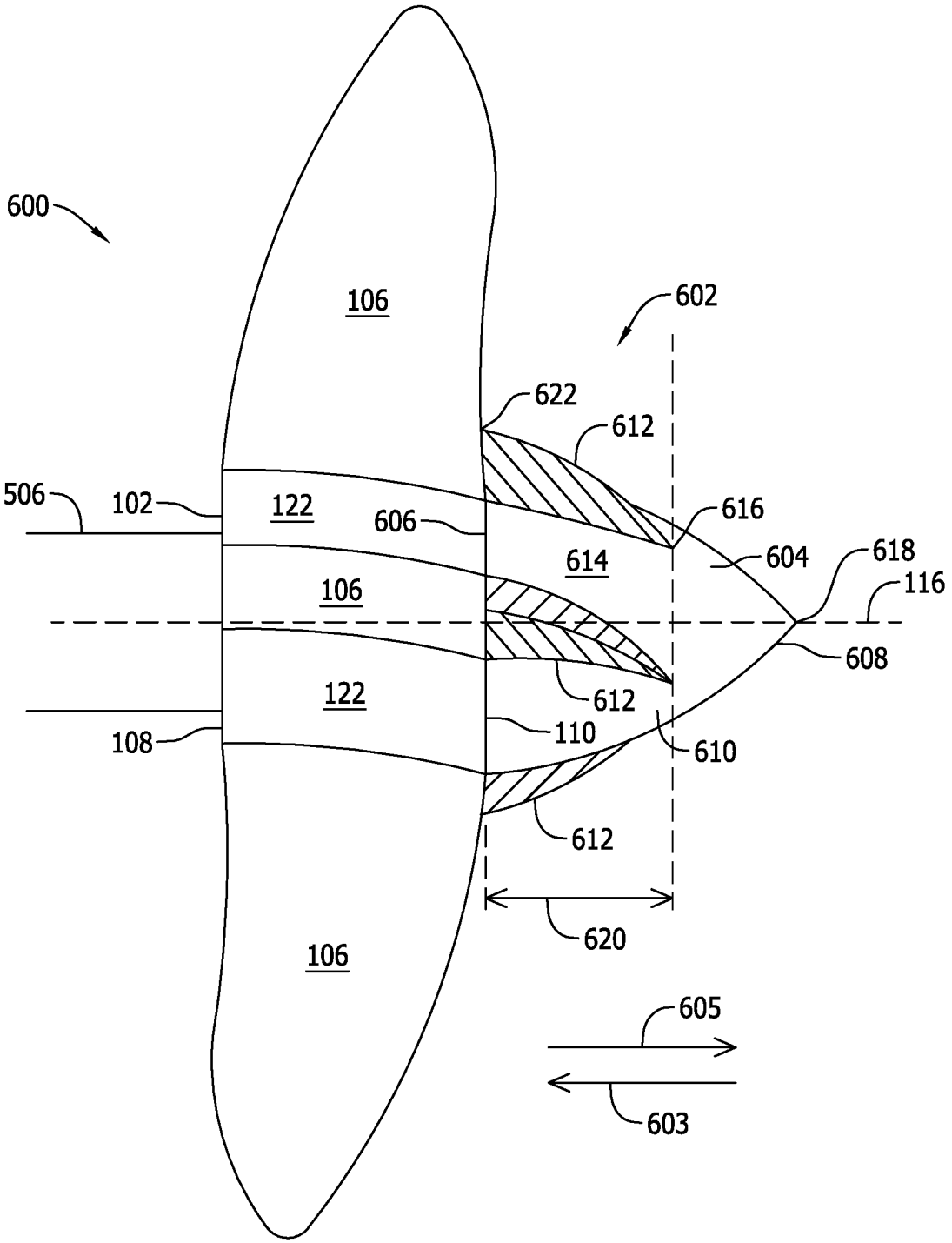
FIG. 6 is a side elevation view of a marine propulsion system in accordance with an example embodiment of the present disclosure.

FIG. 6 is a side elevation view of a marine propulsion system 600 in accordance with an example embodiment of the present disclosure. In the example embodiment, marine propulsion system 600 includes a marine propeller assembly 602 such as, but not limited to marine propeller assembly 100 (shown in FIG. 1) coupled to a rotatable propulsive shaft 506 extending away from a hull of a water craft (not shown in FIG. 6), such as, a cargo ship or tanker. Marine propeller assembly 602 includes hub 102 including forward face 108 wherein "forward" is with respect to a direction 603, aft face 110 wherein "aft" is with respect to a direction 605, and hub body 112 extending therebetween. In some embodiments, hub body 112 is formed of a metal material, such as, but not limited to marine bronze, nickel copper (NiCu) and alloys thereof, and the like. In other embodiments, hub body 112 is formed of a composite material. Hub body 112 is typically coupled to propulsive shaft 506 using a key system. Hub 102 includes a plurality of circumferentially-spaced propeller blades 106. Marine propeller assembly 602 also includes an aft retention member 604 configured to couple to aft face 110. Aft retention member 604 includes a base 606, an opposing nose 608, and a conic body 610 extending therebetween along centerline 116, which is approximately normal to base 606. In various embodiments, base 606 is substantially planar. Aft retention member 604 also includes at least one protuberance 612 extending radially away from a surface 614 of conic body 610. Protuberance 612 extends axially or spirally along an arc extension of dovetail 127 (shown in FIG. 1) from base 606 arcuately convergent to a predetermined point 616 between base 606 and a tip 618 of nose 608. Predetermined point 616 is positioned a predetermined axial distance 620 aft of base 606. Protuberances 612 are embodied as blade extensions configured to hydrodynamically transition a shape of a respective propeller blade 106 of plurality of propeller blades 106 into a shape of conic body 610. In one embodiment, conic body 610 and at least one protuberance 612 are integrally-formed. In other embodiments, at least one protuberance 612 is separately attached to conic body using for example, fasteners, adhesives, and/or weldments.

In various embodiments, propeller blades 106 are formed of a composite structure that includes dovetail 127 (shown in FIG. 1) formed of, for example, a metal material and coupled to a plurality of structural members 302 coupled together to form an interior propeller frame 300. A filler material 308, such as, a structural foam is positioned between plurality of structural members 302. A plurality of tows (not shown in FIG. 6) of composite material at least partially surround interior propeller frame 300 and filler material 308 to form an outer structure of each of propeller blades 106. In one embodiment, plurality of composite propeller blades 106 are joined to hub 102 using dovetail 127 and dovetail groove 126 joint. In other embodiments, plurality of composite propeller blades are joined to hub 102 using dovetail 127 and dovetail wedge 522 joint. Additionally, protuberances are configured to continue a 3-D spiral or twist of blade 106 proximate an aft end 622 of blade 106.

An exemplary technical effect of the methods, systems, and apparatus described herein includes at least one of: (a) aft axial retention for separable marine propeller blades, (b) a hydrodynamically efficient and streamlined conic shape, (c) 3D contours to transition the propeller blade shape to the hub end, and a 3D spiral continuation of blade hub shape.

The above-described embodiments of an apparatus and system of retaining a separable composite marine propeller assembly on a propulsive shaft of a watercraft provides a cost-effective and reliable means for operating and maintaining the marine propeller assembly. More specifically, the apparatus and system described herein facilitate maintaining an axial position of the marine propeller assembly on the shaft while providing a hydrodynamically streamlined flow path for water over the marine propeller assembly. As a result, the apparatus and system described herein facilitate operating a large commercial water craft in a cost-effective and reliable manner.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A marine propeller assembly comprising:

a hub comprising a forward face, an aft face, and a hub body extending therebetween, said hub having a central bore configured to receive and couple to a rotatable propulsive shaft and an outer radial surface having a plurality of circumferentially-spaced flats, each flat being substantially planar and positioned such that adjacent flats together define nonzero angles and each flat receiving a blade dovetail or a wedge thereon, wherein a plurality of propeller blades are spaced circumferentially around the hub and secured thereto by a plurality of wedges, the plurality of propeller blades and plurality of wedges being equal in quantity and alternating around the outer radial surface such that a blade dovetail for each of the plurality of propeller blades is retained against one of the plurality of flats by wedges positioned on opposing circumferential sides of the blade dovetail and each of the plurality of wedges is configured to secure two adjacent ones of the plurality of propeller blades to the hub;

an aft retention member configured to couple to said aft face, said aft retention member comprising:

a base, an opposing nose and a conic body extending therebetween along a centerline normal to said base; and at least one protuberance extending radially away from a surface of said conic body, said protuberance extending from said base arcuately convergent to a predetermined point between said base and a tip of said nose.

2. The marine propeller assembly of claim 1, wherein said conic body is at least partially formed of a composite material.

3. The marine propeller assembly of claim 1, wherein said protuberance is at least partially formed of a composite material.

4. The marine propeller assembly of claim 1, wherein said protuberance is configured to hydrodynamically meld a shape of a respective propeller blade of the plurality of propeller blades into a shape of the conic body.

5. The marine propeller assembly of claim 1, wherein said conic body and said at least one protuberance are integrally-formed.

6. The marine propeller assembly of claim 1, wherein said conic body is at least one of centrifugal catenary-shaped and arcuate A-frame shaped in cross-section.

7. The marine propeller assembly of claim 1, wherein said base is configured to couple to a complementary planar hub surface of a propeller assembly hub.

8. A marine propulsion system comprising:

a rotatable propulsive shaft extending away from a hull of a water craft;

a hub comprising a forward face, an aft face, and a hub body extending therebetween, said hub body formed of at least one of a metal material and a composite material, and coupled to said propulsive shaft, said hub further comprising a plurality of circumferentially-spaced composite propeller blades coupled to a plurality of circumferentially-spaced flats disposed on an outer radial surface of the hub, each of the plurality of circumferentially-spaced composite propeller blades having a blade dovetail retained against a respective one of the plurality of circumferentially-spaced flats by wedges positioned on opposing circumferential sides of the blade dovetail, the plurality of composite propeller blades and wedges being equal in quantity, wherein each one of the wedges secures two adjacent ones of the plurality of circumferentially-spaced composite propeller blades to the hub such that each flat of the plurality of circumferentially-spaced flats is substantially planar and positioned such that adjacent flats together define nonzero angles and each flat is coupled to either a blade or a wedge; and an aft retention member configured to couple to said aft face, said aft retention member comprising:

a base, an opposing nose and a conic body extending therebetween along a centerline normal to said base; and at least one protuberance extending radially away from a surface of said conic body, said protuberance extending axially from said base arcuately convergent to a predetermined point between said base and a tip of said nose.

9. The marine propulsion system of claim 8, wherein said composite propeller blades comprise:

a plurality of structural members coupled together to form an interior propeller frame;

a filler material positioned between said plurality of structural members; and a plurality of tows of composite material at least partially surrounding said interior propeller frame and said filler material.

10. The marine propulsion system of claim 8, wherein said protuberances comprise blade extensions configured to hydrodynamically meld a shape of a respective propeller blade of the plurality of propeller blades into a shape of the conic body.

11. The marine propulsion system of claim 8, wherein said conic body and said at least one protuberance are integrally-formed.

12. The marine propulsion system of claim 8, wherein the blade dovetail is formed of a metal material.

13. The marine propulsion system of claim 8, wherein the wedges are retained against respective ones of the plurality of flats by fasteners.

* * * * *